United States Patent [19]

Kobayashi

[11] Patent Number: 4,809,982

[45] Date of Patent: Mar. 7, 1989

[54] GOLF CLUB HEAD

[75] Inventor: Masashi Kobayashi, Matsudo, Japan

[73] Assignee: Maruman Gold Co., Ltd., Tokyo, Japan

[21] Appl. No.: 8,685

[22] Filed: Jan. 30, 1987

[30] Foreign Application Priority Data

Jan. 31, 1986 [JP] Japan ..... 61-11719[U]

[51] Int. Cl.[4] ..... A63B 53/04

[52] U.S. Cl. ..... 273/167 E; 273/172

[58] Field of Search ..... 273/167 E, 173, 167 A, 273/167 R, 167 F, 167 H, 169, 170, 171, 172, 174

[56] References Cited

U.S. PATENT DOCUMENTS

| | | | |
|---|---|---|---|
| 1,336,671 | 4/1920 | Barkus | 273/167 E |
| 3,468,544 | 9/1969 | Antonious | 273/173 |
| 3,997,170 | 12/1976 | Goldberg | 273/167 E |
| 4,431,192 | 2/1984 | Stuff | 273/167 E |

FOREIGN PATENT DOCUMENTS

| | | |
|---|---|---|
| 48-60672 | 8/1973 | Japan . |
| 50-85367 | 7/1975 | Japan . |
| 59-24276 | 7/1975 | Japan . |
| 51-116060 | 9/1976 | Japan . |
| 59-33459 | 3/1984 | Japan . |

*Primary Examiner*—George J. Marlo

*Attorney, Agent, or Firm*—Armstrong, Nikaido, Marmelstein & Kubovcik

[57] ABSTRACT

A golf club head is provided with a straight through hole for the passage of air extending from an inlet in the sole to an outlet in the central back side.

2 Claims, 4 Drawing Sheets

GOLF CLUB HEAD

BACKGROUND OF THE INVENTION

1. Field of the Invention

The present invention relates to a head of a golf club and, more particularly, to an improvement of a head of a golf club having therein a through hole for allowing air to pass therethrough during a swing of the club, to reduce aerodynamic resistance acting on the head during the swing.

2. Description of the Related Art

When a conventional head is swung at an ordinary kinetic speed, an air flow boundary layer in form of a laminar air flow boundary layer and/or a turbulent air flow boundary layer, i.e., an intermediate boundary layer at the point of transition from a laminar air flow to a turbulent air flow, is produced on the outer surface of the head within a region between the face side and the back side of the head. The air flow boundary layer is exfoliated at the rear end thereof from the outer surface of the head, and thus a subatmospheric pressure region is created behind the head. Therefore, a turbulent air flow or swirling air stream is produced behind the head by the subatmospheric pressure.

In this air stream condition around the head during a swing, air in front of the head is compressed and the air pressure increased, but the air pressure behind the head is reduced. Accordingly, an aerodynamic drag due to the pressure difference in front of and behind the head (hereinafter referred to as "pressure drag") is imposed on the head during the swing. It is known that such a pressure drag reduces the head speed during the swing, and thus reduces a distance of flight of a ball hit by the head. It is also known that such a pressure drag has an adverse affect on the stability of the movement of the head during the swing.

Japanese Unexamined Utility Model Publication Nos. 48-60672, 50-85367, 51-116060, and 59-33459, and Japanese Examined Utility Model Publication No. 50-24276 discloses a conventional head of a golf club in which a head body having a face side for hitting a golf ball is formed with at least one through hole allowing air to pass therethrough, for reducing air resistance or wind pressure acting on the head body during a swing. In this type of head, the through hole is open at the front and rear ends thereof in the face and rear sides of the head, respectively, so that an air pressure difference between the front of and behind the head, produced during a swing of the head, can be reduced.

However, in the conventional head having the above-mentioned through hole, since the front end of the through hole is open in the face side of the head for hitting a golf ball, at the center of the face side or in the vicinity of the toe or heel side of the head, the head tends to hit a golf ball at an area in which the front end of the through hole is open. Accordingly, when a ball is hit by a head having a through hole at an area in which the front end of the through hole is open, an even stress is produced in the ball, and thus the direction of flight of the ball hit by the head is deteriorated. Particularly, when a front end of a through hole is open in a face side of the head in the vicinity of the toe or heel side of the head, and a golf ball is hit by the head at a region in which a through hole is open, it becomes difficult to produce side spin on the ball due to a reduction of the area of the head in contact with the ball. As the result, the direction of flight of a ball hit by the head is deteriorated.

SUMMARY OF THE INVENTION

According to the present invention, there is provided a head of a golf club comprising a head body having a face side for hitting a golf ball and back, sole, top, toe, and heel sides which define the outer surface of the head body, the head body having at least one through hole formed therein for allowing air to pass therethrough, the through hole having an air inlet which opens in the outer surface of the head body at a position located between the face side and the back side and an air outlet which opens in the outer surface of the head body substantially at the center of the back side of the head body.

In the golf club head according to the present invention, a part of air pressurized to a relatively high pressure by the head body in front of the head body is easily fed into the through hole through the air inlet during a swing of the head, and thus the air having a relatively high pressure passes through the through hole and is actively fed from the air outlet of the through hole into a region behind the head body. Accordingly, an air pressure difference in front of and behind the head body can be reduced by actively feeding the air through the through hole during the swing, and thus a pressure drag imposed on the head body during the swing can be reduced. Therefore, a kinetic speed of the head during the swing can be increased and the swing orbit of the head can be stabilized. As the result, a distance of flight of a ball hit by the head can be increased and a direction of flight of the ball can be improved.

At least one air inlet of the through hole may be located in any one of the top, sole, or toe side of the head body in the vicinity of periphery of the face side of the head body.

The foregoing and other advantages of the present invention will be better understood from the following description with reference to the preferred embodiments illustrated in the drawings.

DESCRIPTION OF THE PREFERRED EMBODIMENTS

Figure 1:
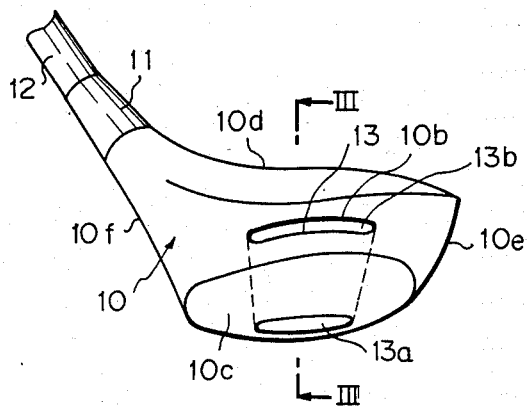
FIG. 1 is a perspective view of a head of a golf club illustrating a first embodiment of the present invention applied to a so-called wood club head.
Figure 2:
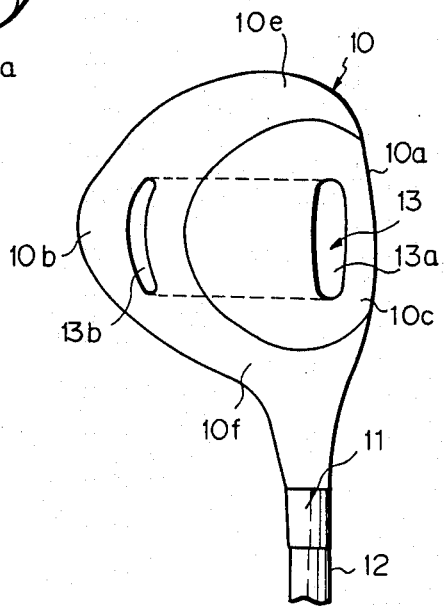
FIG. 2 is a bottom side view of the head shown in FIG. 1.
Figure 3:
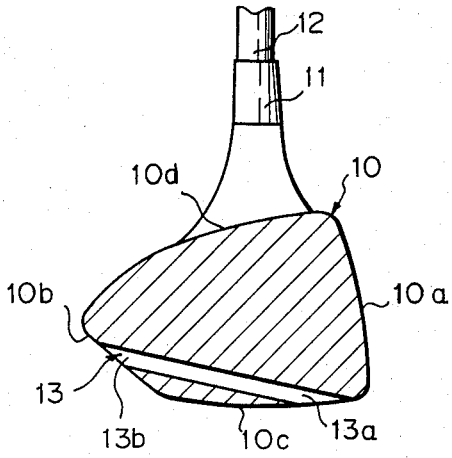
FIG. 3 is a cross-sectional side view of the head shown in FIG. 1 taken along the line III—III in FIG. 1.

FIGS. 1 to 3 show a first embodiment of the present invention applied to a so-called wood club head. Referring to these FIGURES, a head of the golf club comprises a head body 10 which is connected to a club shaft 12 through a neck or hosel portion 11 formed integrally with the head body 10. The head body 10 has a face side 10*a* for hitting a golf ball (not shown), a back side 10*b*, a sole side 10*c*, a top side 10*d*, a toe side 10*e*, and a heel side 10*f*. The sole, top, toe, and heel sides 10*c*, 10*d*, 10*e*, and 10*f* extend between the face side 10*a* and back side 10*b* of the head body 10. The head body 10 has a through hole 13 formed therein for allowing air to pass therethrough. The through hole 13 passes through the head body 10 and has an air inlet 13*a* which opens in the outer surface of the head body 10 at a position in the sole side 10*c* in the vicinity of the face side 10*a* and an air output 13*b* which opens in the outer surface of the head body 10 at a position substantially in the center of the back side 10*b* of the head body 10.

The head body 10 having the through hole 13 may be made of a conventional material such as, for example, wood, metal, plastic, fiber-reinforced plastic, of a composite of metal and plastic. The through hole 13 can be easily formed in the head body 10 by drilling after the outer shape of the head body 10 is formed. Where the head body 10 is made of metal by a lost-wax process, the through hole 13 can be easily formed in the head body by such a lost-wax process.

Figure 4:
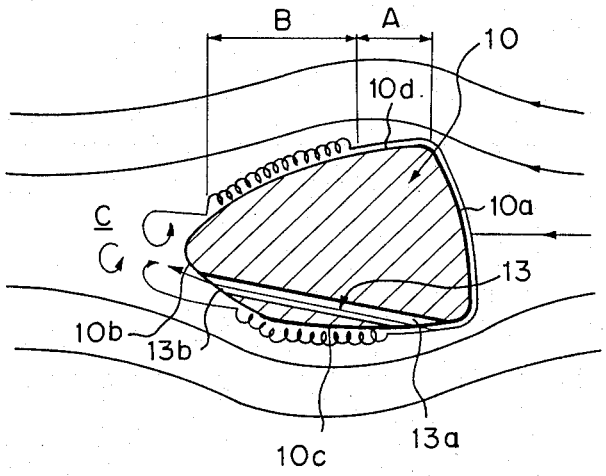
FIG. 4 is a cross-sectional side view similar to FIG. 2 and schematically illustrating the state of air streams produced around the head during the swing.
Figure 10:
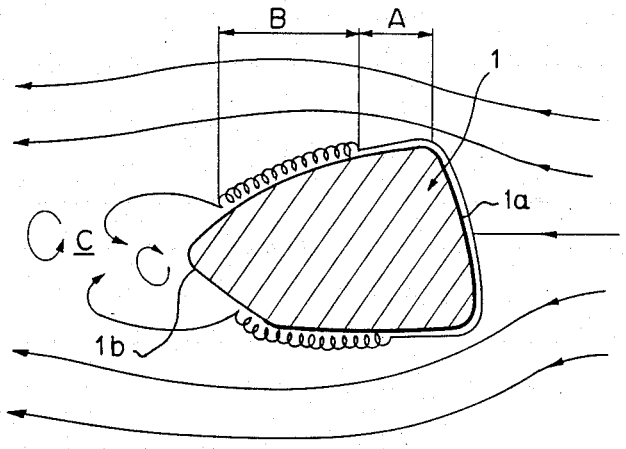
Fig. 10 PRIOR ART
FIG. 10 is a cross-sectional view of a conventional head schematically illustrating the state of air streams produced around the head during the swing.

FIG. 4 schematically illustrates the state of air streams produced around the above-mentioned head 10 of the present invention during a swing of the head 10. Referring to FIG. 4, a laminar air flow boundary layer is produced on the outer surface of the head body 10 within a first region A, and a turbulent air flow boundary layer is formed on the outer surface of the head body 10 within a second region B. At the rear end of the turbulent air flow boundary layer, the air stream is exfoliated from the outer surface of the head body 10. In turn, FIG. 10 schematically illustrates the state of air streams produced around the conventional ordinary head 1 duing a swing of the head 1. Referring to FIG. 10, a laminar air flow boundary layer is produced on the outer surface of the head body 1 within a first region A, and a turbulent air flow boundary layer is formed on the outer surface of the head body 1 within a second region B. At the rear end of the turbulent air flow boundary layer, the air stream is exfoliated from the outer surface of the head body 1. As easily seen from FIG. 10, a subatmospheric pressure region C is produced behind the head body 1 due to the exfoliation of the air streams during the swing, and swirling streams are produced behind the head body 1 due to the subatmospheric pressure. The swirling streams accelerate the exfoliation of air streams from the outer surface of the head body, and thus increase the subatmospheric region C behind the head body 1. Accordingly, an air pressure difference in front of and behind the head body 1 is increased, and a relatively large pressure drag due to the air pressure difference is imposed on the head body 1 during the swing. As a result, a kinetic speed of the head during the swing is reduced and the swing orbit of the head becomes unstable.

In comparison to this, in the head according to the present invention, a part of the air pressurized at a relatively high pressure by the head body 10 in front of the head body 10 is easily fed into the through hole 13 through the air inlet 13*a* during the swing, and thus the air having a relatively high pressure is allowed to pass through the through hole 13 and is actively fed from the air outlet 13*b* of the through hole 13 into the subatmospheric region C behind the head body 10 during the swing. Accordingly, an air pressure drop behind the head body 10 can be reduced, and thus an air difference in front of and behind the head body 10 can be reduced. Further, the swirling streams produced behind the head body 10 can be reduced by an air jet stream fed from the through hole 13 into the region C, and thus acceleration of the exfoliation of the air stream from the outer surface of the head body 10 upon the influence of the swirling streams behind the head body 10 can be prevented. Accordingly, a pressure drag imposed on the head body 10 can be reduced. Therefore, a kinetic speed of the head during the swing can be increased and the swing orbit of the head can be stabilized. As the result, a distance of flight of a ball hit by the head is increased and the direction of flight of the ball can be improved.

Since the air inlet 13*a* of the through hole 13 is open in the outer surface of the head body 10 within a region where the laminar air flow boundary layer is produced, as shown in FIG. 4, it is possible to effectively reduce pressure drop and the production of swirling streams behind the head body 10 during the swing.

Further, in the above-mentioned golf club head, since the air inlet 13*a* of the through hole 13 is open in the sole side 10*a* of the head body 10, the peripheral edge of the air inlet 13*a* of the through hole 13 does not come into contact with the ball when the head body 10 hits the ball. Therefore, deterioration of the direction of flight of the ball can be prevented.

Figure 5:
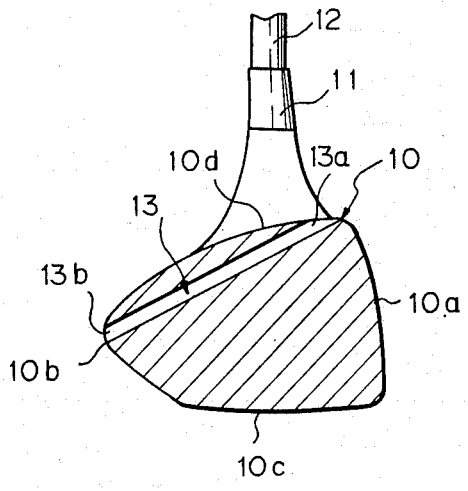
FIG. 5 is a cross-sectional side view of a so-called wood head of a golf club illustrating a second embodiment of the present invention.
Figure 6:
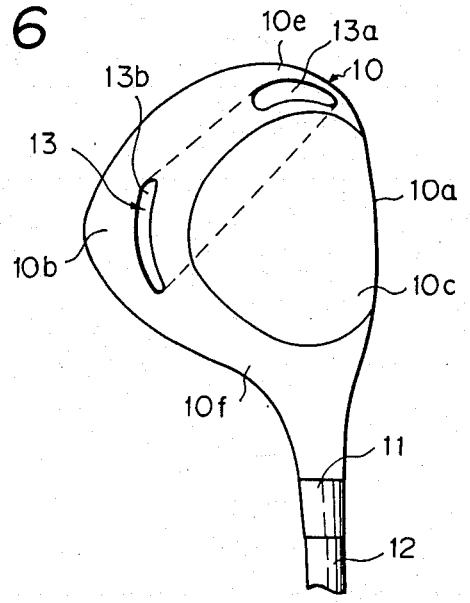
FIG. 6 is a bottom side view of a so-called wood head of a golf club illustrating a third embodiment of the present invention.

FIGS. 5 and 6 illustrate second and third embodiments of the present invention applied to a so-called wood club head, respectively. In these FIGURES, the same constituent elements as in the above-mentioned first embodiment are represented by the same reference numerals. In the second embodiment shown in FIG. 5, the air inlet 13*a* of the through hole 13 opens in the outer surface of the head body 10 at a position in the top side 10*d* of the head body 10 in the vicinity of the face side 10*a* so that the air inlet 13*a* is located within a region where a laminar air flow boundary layer is produced. In the third embodiment shown in FIG. 6, the air inlet 13*a* of the through hole 13 is open in the outer surface of the head body 10 at a position in the toe side 10*e* of the head body 10 in the vicinity of the face side 10*a* so that the air inlet 13*a* is located within a region where a laminar air flow boundary layer is produced. In the second and third embodiment, the air outlet 13*b* of the through hole 13 is open in the outer surface of the head body 10 substantially at the center of the back side 10*b*. Accordingly, the through hole 13 shown in FIGS. 5 and 6 can provide aerodynamic characteristics substantially the same as that of the first embodiment, on the head body 10.

In the first embodiment, the air inlet 13*a* of the through hole 13 opens in the sole side 10*c* of the head body 10 as mentioned above. Therefore, when the sole side 10*c* of the head body 10 of the first embodiment comes into contact with the ground or grass during the swing, the soil or grass is apt to enter the air inlet 13*a* of the through hole 13. In comparison, the air inlet 13*b* of the through hole 13 in the second and third embodiments is not open in the sole side 10*c* of the head body 10, so the head body 10 can be smoothly swung even when the sole side 10c of the head body 10 comes into contact with the ground or grass during the swing.

Figure 7:
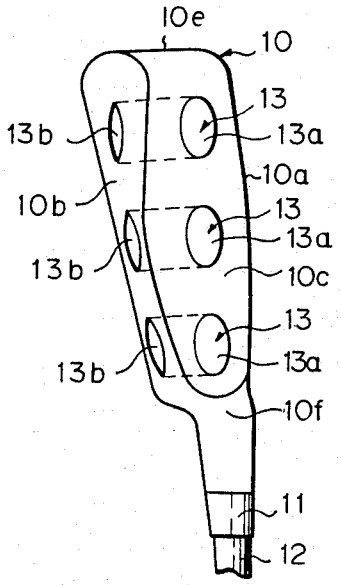
FIG. 7 is a bottom side view of a so-called iron head of a golf club illustrating a fourth embodiment of the present invention.

FIG. 7 illustrates a fourth embodiment of the present invention applied to a so-called iron club head. In FIG. 7, the same constituent elements as in the first embodiment are represented by the same reference numerals In the fourth embodiment, three through holes 13 separated from one another are formed in the iron head body 10. The air inlets 13a of the holes 13 are open in the outer surface of the head body 10 at positions located in the sole side 10c of the head body 10 in the vicinity of the face side 10a of the head body 10, and the air outlets 13b open in the outer surface of the head body 10 substantially at the center of the back side 10b of the head body 10. The air inlets 13a of the holes 13 are disposed in a direction substantially parallel to the face side 10a.

It will be apparent that the through holes 13 shown in FIG. 7 can provide aerodynamic characteristics substantially the same as that of the first embodiment on the head body 10. Further, in the fourth embodiment, the magnitude of a pressure drag imposed on the head body 10 during the swing can be easily changed by closing at least one of the air inlets 13a of the three holes 13 with a plug. Accordingly, it becomes possible to provide a golf club head having an aerodynamic characteristic adjustable for individual players.

Figure 8:
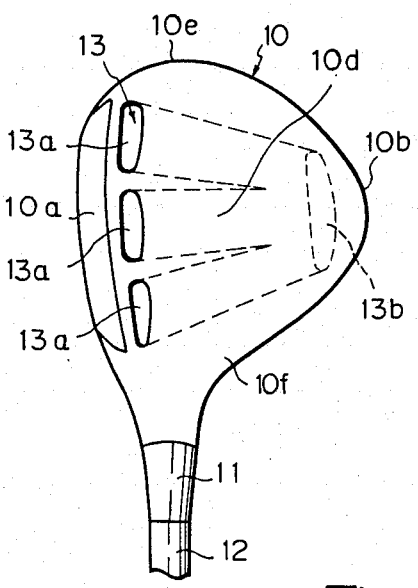
FIGS. 8 and 9 are plan views of a so-called wood head of a golf club illustrating a fifth and sixth embodiments of the present invention, respectively.
Figure 9:
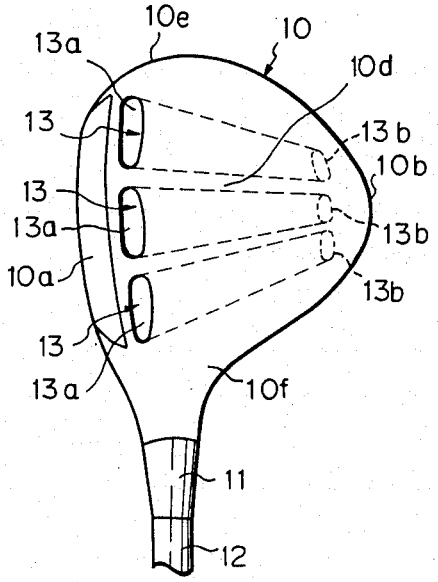

FIGS. 8 and 9 illustrate a fifth and sixth embodiments of the present invention applied to a so-called wood type club head, respectively. In these Figures, the same constituent elements as in the first embodiment are represented by the same reference numerals.

In the fifth embodiment shown in FIG. 8, a through hole 13 formed in the head body 10 has three separate air inlets 13a and one air outlet 13b. The air inlets 13a of the hole 13 are located in the top side 10d of the head body 10 in the vicinity of the face side 10a, while the air outlet 13b is located substantially at the center of the back side 10b of the head body. At least one of the air inlets 13a of the hole 13 may be located in the sole side (not shown in FIG. 8) or toe side 10e of the head body 10.

In the sixth embodiment shown in FIG. 9, three through holes 13, each having an air inlet 13a and an air outlet 13b, are formed in the head body 10. The air inlets 13a of the holes 13 are located in the top side 10d of the head body 10 in the vicinity of the face side 10a and the air outlets 13b of the hole 13 are located substantially at the center of the back side 10b of the head body 10. At least one of the air inlets 13a of the hole 13 may be located in the sole side (not shown in FIG. 9) or the toe side 10e of the head body 10.

Although particular embodiments of the present invention illustrated in the drawings have been described, it will be understood, of course, that the present invention is not limited thereto since modifications can be easily made by those skilled in the art in the light of the foregoing teachings. For example, the number of through holes formed in the head body may be changed. Further, the present invention can be applied to a head having a hollow structure, such as so-called hollow metal head, in such a manner that a pair of apertures is formed in the wall of the hollow head body and then a pipe is fitted at the opposite ends thereof into apertures and secured at the opposite ends thereof to the wall of the head body, so as to form a through hole in the head body. Alternately, a connecting bar connecting the opposite inner wall of the hollow head body may be formed integrally with the head body, and then a through hole passing through the connecting bar and walls of the head body may be formed by drilling.

I claim:

1. A head of a golf club comprising a head body having a face side for hitting a golf ball, a back side at an opposite side of said face side and an outer surface extending substantially between said face side and back side and having a sole side, said head body having a substantially straight through hole formed therein for allowing air to pass therethrough, said through hole having a first opening which opens in said sole side of said head body in proximity of said face side and a second opening which opens substantially at the middle portion of said back side of said head body.

2. A head of a golf club according to claim 1, wherein said head body is connected at the heel side thereof to a club shaft through a neck portion which is formed integrally with said head body.

* * * * *

UNITED STATES PATENT AND TRADEMARK OFFICE

CERTIFICATE OF CORRECTION

PATENT NO. : 4,809,982

DATED : March 7, 1989

INVENTOR(S) : KOBAYASHI

It is certified that error appears in the above-identified patent and that said Letters Patent is hereby corrected as shown below:

On the cover page, Item [73], "Maruman Gold Co., Ltd." should read --Maruman Golf Co., Ltd.--.

Signed and Sealed this

Twenty-first Day of November, 1989

*Attest:*

JEFFREY M. SAMUELS

*Attesting Officer* *Acting Commissioner of Patents and Trademarks*